US008545050B2

(12) United States Patent
Lee

(10) Patent No.: US 8,545,050 B2
(45) Date of Patent: Oct. 1, 2013

(54) BULBTYPE LAMP WITH LIGHT EMITTING DIODES USING ALTERNATING CURRENT

(75) Inventor: Choong Hae Lee, Seoul (KR)

(73) Assignee: Gwangsung Lighting Industry Co., Ltd., Incheon (KR)

( * ) Notice: Subject to any disclaimer, the term of this patent is extended or adjusted under 35 U.S.C. 154(b) by 375 days.

(21) Appl. No.: 12/744,922

(22) PCT Filed: Oct. 29, 2008

(86) PCT No.: PCT/KR2008/006365

§ 371 (c)(1),
(2), (4) Date: May 26, 2010

(87) PCT Pub. No.: WO2009/069894

PCT Pub. Date: Jun. 4, 2009

(65) Prior Publication Data

US 2011/0037386 A1 Feb. 17, 2011

(30) Foreign Application Priority Data

Nov. 27, 2007 (KR) ..... 20-2007-0019060 U

(51) Int. Cl.
*F21V 5/00* (2006.01)

(52) U.S. Cl.
USPC ..... 362/246; 313/45

(58) Field of Classification Search
USPC ..... 362/244, 246; 313/45
See application file for complete search history.

(56) References Cited

U.S. PATENT DOCUMENTS

| | | | | |
|---|---|---|---|---|
| 5,013,967 | A * | 5/1991 | Hirotaka et al. | 313/512 |
| 6,709,132 | B2 | 3/2004 | Ishibashi | |
| 6,982,518 | B2 | 1/2006 | Chou et al. | |
| 2002/0105266 | A1 * | 8/2002 | Juestel et al. | 313/512 |
| 2006/0232974 | A1 * | 10/2006 | Lee et al. | 362/294 |
| 2007/0285926 | A1 * | 12/2007 | Maxik | 362/294 |

FOREIGN PATENT DOCUMENTS

| | | | |
|---|---|---|---|
| JP | 2005-158746 | A | 6/2005 |
| JP | 2005-166578 | A | 6/2005 |

* cited by examiner

*Primary Examiner* — Anh Mai
*Assistant Examiner* — Andrew Coughlin
(74) *Attorney, Agent, or Firm* — Rabin & Berdo, P.C.

(57) ABSTRACT

Provided is a bulbtype AC power LED lamp. The bulbtype AC power LED lamp includes an AC power LED board, a diffuser, a board base, an insulation base, a socket, and a bulb. The AC power LED board is in contact with the board base on which a heat sink is disposed to maximize heat emission efficiency during turn-on of the AC power LED. Also, light is diffused by the diffuser during turn-on of the AC power LED to prevent dazzling phenomenon as well as extend a lighting area.

3 Claims, 3 Drawing Sheets

BULBTYPE LAMP WITH LIGHT EMITTING DIODES USING ALTERNATING CURRENT

BACKGROUND OF THE INVENTION

1. Field of the Invention

The present invention relates to a lamp, and more particularly, a bulbtype lamp with light emitting diodes (LEDs) using an alternating current (AC).

2. Description of the Related Art

In general, incandescent lamps or fluorescent lamps are widely used as light sources such as a domestic lighting, an interior lighting, and a stage lighting. However, the incandescent lamps and the fluorescent lamps have significantly higher power consumption and poor durability.

Recently, an LED lamp using a direct current (hereinafter, referred to as a "DC power LED lamp") that is a kind of lamp having lower power consumption, a lower illumination intensity, and superior durability is being developed.

FIG. 1 is a view of a related art DC power LED lamp 10. The DC power LED lamp 10 includes a case 12, an LED board 13, a driving board 14, an auxiliary case 15, and a socket 16. An upper portion of the case 12 is covered by a lens 11, and a heat sink is disposed on an outer surface of the case 12. The LED board 13 is built in the case 12 and includes at least one or more DC power LEDs. The driving board 14 is built in the case 12 and supplies a DC power for driving the LED board 13. The auxiliary case 15 is connected to a lower portion of the case 12 to cover the lower portion of the case 12. The socket 16 is connected to a lower portion of the auxiliary case 15.

In the related art DC power LED lamp 10 including the above-described components, the driving board 14 converts a general AC power inputted through the socket 16 connected to an AC power input terminal to a predetermined DC power to supply the converted DC power to the DC power LEDs of the LED board 13. Thus, the plurality of DC power LEDs turns on.

Also, heat generated during the turn-on of the DC power LEDs is transmitted to the case 12 on which the heat sink is disposed on the outer surface thereof, and then emitted to the outside. Thus, it prevents the DC power LED lamp 10 from being overheated.

SUMMARY OF THE INVENTION

However, in the related art DC power LED lamp 10, since the LED board 13 is spaced a predetermined distance from the driving board 14 as illustrated in FIG. 1, heat emission efficiency through the heat sink of the case 12 is reduced.

That is, a portion of the heat generated from the LED board 13 and the driving board 14 during the turn-on of the DC power LEDs is directly conducted to the board base 12 through a side surface of the LED board 13 and a side surface of the driving board 14, and then is emitted to the outside. However, the other portion of the heat is conducted to the case 12 via a space between the LED board 13 accumulating the heat and the driving board 14 to reduce heat conductive efficiency. Thus, the heat emission efficiency through the heat sink of the case 12 is reduced.

Most of the heat generated during the turn-on of the DC power LED (for example, approximately more than 90%) is emitted to the outside through the bottom surface of the LED board 13. When the emitted heat is not directly conducted to the case 12, but stays in the space between the LED board 13 and the driving board 14, it has a bad effect on the LED board 13 as well as various circuit devices of the driving board 14 to frequently cause malfunction.

Also, in the related art DC power LED lamp 10, since the light has a strong straight traveling property, dazzling phenomenon is easily caused, and a lightening range, e.g., the lighting area is limited.

An object of the present invention is to provide a bulbtype AC power LED lamp in which side surfaces and a bottom surface of an AC power LED board including an AC power LED instead of a DC power LED can be directly contacted with a board base on which a heat sink is disposed along an entire outer surface to maximize emission efficiency of heat generated during turn-on of the AC power LED.

Another object of the present invention is to provide a bulbtype AC power LED lamp in which a board base on which a heat sink is disposed along an entire outer surface and a socket connected to an AC power input terminal are connected to each other using an insulation base to completely interrupt heat emitted to the outside through the board base from being conducted to the socket.

A further object of the present invention is to provide a bulbtype AC power LED lamp in which an AC power LED is surrounded by a diffuser to diffuse light generated during turn-on of the AC power LED, thereby to prevent dazzling phenomenon as well as extend a lighting area.

According to an aspect of the present invention, there is provided a bulbtype AC power LED lamp including: an AC power LED board on which an AC power LED is mounted; a diffuser fixed to the AC power LED board to surround the AC power LED, the diffuser diffusing light of the AC power LED; a board base in which the AC power LED board is insertedly attached to the inside of a board fixing groove, side surfaces and a bottom surface of the AC power LED board are in contact with an inner surface of the board fixing groove, a bulb fixing groove extends along a circumference of the board fixing groove, a first power connection hole passes through the board base, and a heat sink is disposed along an entire outer surface of the board base; an insulation base in which a second power connection hole passing through the inside of the insulation base and communicating with the first power connection hole is defined, the insulation base being connected to a lower end of the board base; a socket connected to a lower end of the insulation base, the socket being inserted into the first power connection hole and the second power connection hole to supply an AC power to the AC power LED through a power connection unit electrically connected to the AC power LED board; and a bulb inserted into the bulb fixing groove to cover the AC power LED board.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Hereinafter, the present invention will be described in detail with reference to the accompanying drawings.

Figure 2:
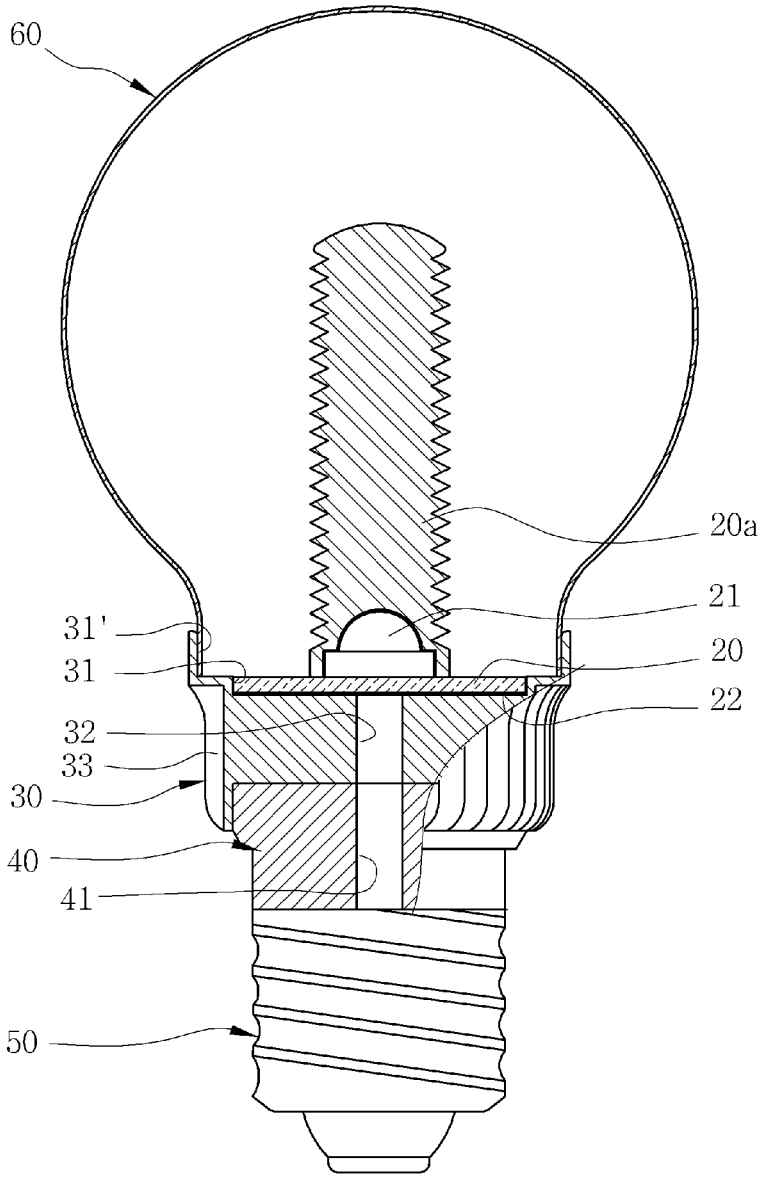
FIG. 2 is a view of a bulbtype AC power LED lamp according to an embodiment of the present invention.

Referring to FIG. 2, an AC power LED 21 is mounted on an AC power LED board 20.

At least one or more AC power LEDs 21 may be mounted on the AC power LED board 20. For example, two AC power LEDs 21 are mounted in FIGS. 3 and 4.

Figure 3:
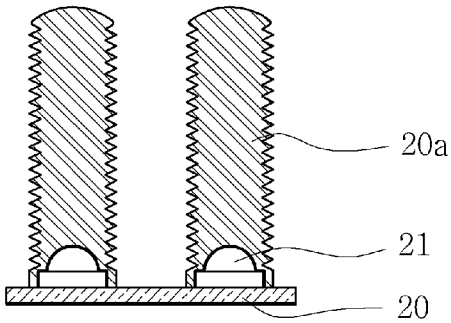
FIG. 3 is a view of a bulbtype AC power LED lamp according to another embodiment of the present invention.
Figure 4:
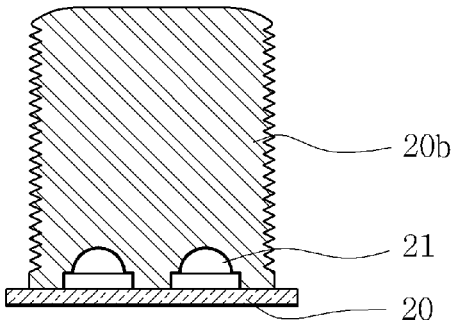
FIG. 4 is a view of a bulbtype AC power LED lamp according to further another embodiment of the present invention.

The at least one or more AC power LEDs 21 are separately surrounded by diffusers 20*a* to diffuse light as illustrated in FIG. 3, or all of the AC power LEDs 21 are surrounded by a diffuser 20*b* to diffuse light as illustrated in FIG. 4.

The AC power LED board 20 includes a metal printed circuit board (PCB) formed of aluminum alloy. The AC power LEDs 21 are mounted using a surface-mount technology to fabricate the AC power LED board 20. A double-sided adhesive thermal conductive tape 22 formed of graphite having a relatively lower cost than that of aluminum and having thermal conductivity and heat-resistance similar to those of aluminum is attached to a bottom surface of the AC power LED board 20.

The AC power LED board 20 adheres to a board base 30 using the thermal conductive tape 22.

A double-sided adhesive thermal conductive tape 22 formed of acrylic resin or silicon except the graphite may be used as the thermal conductive tape 22.

The diffusers 20*a* and 20*b* are fixed to the AC power LED board 20 to surround the AC power LEDs 21. The diffusers 20*a* and 20*b* diffuse the light of the AC power LEDs 21 to prevent dazzling phenomenon and extend a lighting area. The diffusers 20*a* and 20*b* are formed of a glass or a heat resistant polymer acrylic resin.

The AC power LED board 20 is insertedly attached to the inside of a board fixing groove 31 defined in a top surface of the board base 30. Both side surfaces and the bottom surface of the AC power LED board 20 are in contact with an inner surface of the board fixing groove 31. A bulb fixing groove 31' extends along a circumference of the board fixing groove 31. A first power connection hole 32 passes through the board base 30. A heat sink 33 is disposed along an outer surface of the board base 30.

An inner surface of the first power connection hole 32 is heat-resistantly treated and insulated to prevent heat emitted from the AC power LED board 20 to the heat sink 33 of the board base 30 from being conducted to a power connection unit.

An insulation base 40 is formed of a heat resistance insulation material. The insulation base 40 is connected to a lower end of the board base 30 and passes through the board base 30 to define a second power connection hole 41 communicating with the first power connection hole 32.

The insulation base 40 completely prevents the heat emitted into the outside through the board base 30 from being conducted to a socket 50.

The socket 50 is connected to a normal AC power input terminal and connected to a lower end of the insulation base 40. The socket 50 is inserted into the first power connection hole 32 and the second power connection hole 41 to supply an AC power to the AC power LEDs 21 through the power connection unit electrically connected to the AC power LED board 20.

The power connection unit may include a normally electric wire or lead wire.

A bulb 60 is inserted into the bulb fixing groove 31' to cover the AC power LED board 20. The bulb 60 is formed of a heat resistant polymer acrylic resin.

The bulbtype AC power LED lamp including the above-described components according to the present invention operates according to a following operation. Hereinafter, specific operation procedures of the bulbtype AC power LED lamp will be described with reference to FIG. 2.

The heat generated from the AC power LED board 20 insertedly fixed to the board fixing groove 21 is emitted to the outside through two paths during turn-on of the AC power LED 21 disposed on the AC power LED board 20 by the AC power supplied into the board base 30 through the socket 50

Firstly, a portion of the heat generated from the AC power LED board 20 is directly conducted to the board base 30 in contact with the side surfaces of the AC power LED board 20, and then is emitted to the outside through the heat sink 33 disposed on the outer surface of the board base 30.

Secondly, the other portion of the heat generated from the AC power LED board 20 is directly conducted to the board base 30 via the bottom surface of the AC power LED board 20 and the thermal conductive tape 22, and then is emitted to the outside through the heat sink 33 disposed along the outer surface of the board base 30.

When the heat is conducted by directly contacting the side surfaces and the bottom surface of the AC power LED board 20 with the board base 30 on which the heat sink 30 is disposed along the outer surface thereof, emission efficiency of the heat generated during the turn-on of the AC power LED 21 is maximized, thereby significantly improving the emission efficiency than that of a related art DC power LED lamp. Therefore, it can prevent the bulbtype AC power LED lamp according to the present invention from being overheated.

Since the heat emitted to the outside through the board base 30 is completely interrupted by the heat resistance insulation base 40 connecting the board base 30 to the socket 50 to prevent the heat from being conducted to the socket 50.

When the bulbtype AC power LED lamp according to the present invention turns on, light straightly emitted from the AC power LED 21 disposed on the AC power LED board 20 is diffused by the diffuser 20*a* and emitted via the bulb 60 to prevent the dazzling phenomenon as well as extend a lightening range, e.g., the lighting area.

Figure 1:
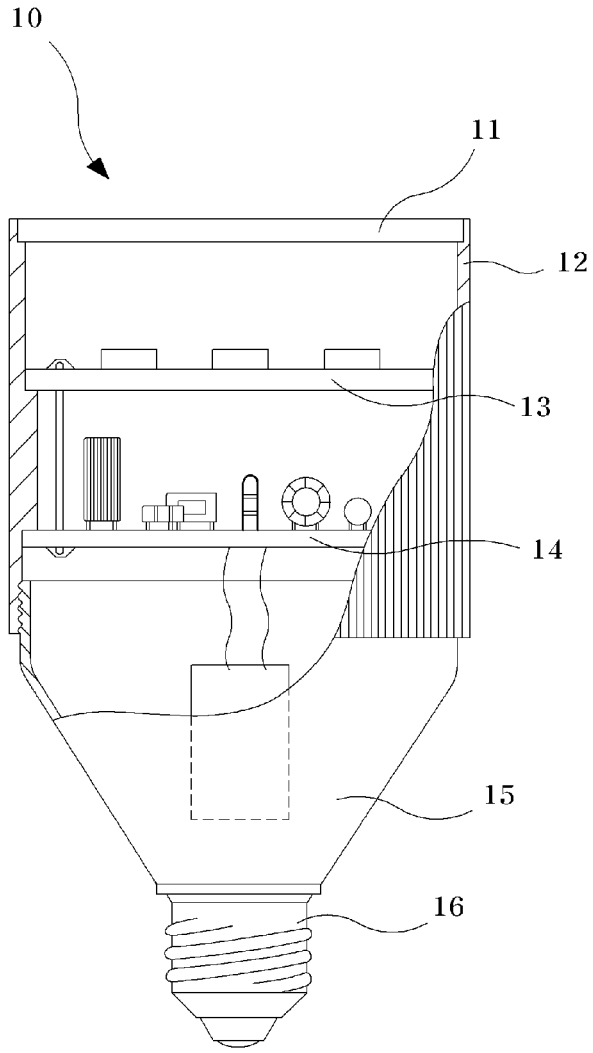
FIG. 1 is a view of a related art DC power LED lamp.

Referring to measurement results of temperatures and quantities of light measured by an inventor under the same condition with respect to the bulbtype AC power LED lamp according to the present invention and the related art DC power LED lamp 10 illustrated in FIG. 1, differences shown in Table 1 could be confirmed.

TABLE 1

| Measurement items | Related art LED lamp | LED lamp of the present invention |
|---|---|---|
| Temperature | 100° C. | Less than 80° C. |
| Quantity of light | 80% of reference quantity of light | More than 90% of reference quantity of light |

According to Table 1, heatsink efficiency of the present invention was improved, and the quantity of light was increased when compared with the related art LED lamp. When the temperature of the LED lamp decreases more than 10° C., life and illumination of LED itself can be improved. In case where a temperature deviation ranges from about 10° C. to about 15° C., a deviation of the LED's life ranges from several hundred hours to several thousand hours.

Also, although it makes a little difference according to a configuration of the diffuser, the light of the AC power LED 21 was diffused to extend the lighting area up to more than 180 degrees.

Actually, in the bulbtype AC power LED lamp according to the present invention, when the light of the AC power LED is diffused using the diffuser, the lighting area can be expended to a lighten area equal to or similar to a lighten area that can be lightened using a normal incandescent lamp.

As described above, in the bulbtype AC power LED lamp according to the present invention, since the side surfaces and the bottom surface of the AC power LED board are directly contacted with the board base on which the heat sink is disposed along the outer surface thereof, the emission efficiency of the heat generated during the turn-on of the AC power LED 21 is maximized, thereby significantly improving the emission efficiency than that of the related art DC power LED lamp.

Since the heat resistance insulation base is connected between the board base on which the heat sink is disposed along the outer surface thereof and to the socket connected to the AC power input terminal, the heat emitted to the outside through the board base can be completely interrupted from being conducted to the socket.

Also, since the diffuser surrounds the AC power LED, the light generated during the turn-on of the AC power LED is diffused to prevent the dazzling phenomenon as well as extend the lighting area.

The bulbtype AC power LED lamp may be embodied in different forms and should not be construed as limited to the embodiments set forth herein. It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A bulbtype AC power LED lamp comprising:

an AC power LED board (20) on which an AC power LED (21) is mounted;

a diffuser (20*a*) fixed to the AC power LED board (20) to surround the AC power LED (21), the diffuser (20*a*) diffusing light of the AC power LED (21);

a board base (30) in which the AC power LED board (20) is insertedly attached to the inside of a board fixing groove (31), side surfaces and a bottom surface of the AC power LED board (20) are in contact with an inner surface of the board fixing groove (31), a bulb fixing groove (31') extends along a circumference of the board fixing groove (31), a first power connection hole (32) passes through the board base (30);

a heat sink (33) disposed along an entire outer surface of the board base (30), wherein the heat sink (33) comes in contact with an outer periphery of the board base (30);

an insulation base (40) in which a second power connection hole (41) passing through the inside of the insulation base (40) and communicating with the first power connection hole (32) is defined, the insulation base (40) being connected to a lower end of the board base (30);

a socket (50) connected to a lower end of the insulation base (40), the socket (50) being inserted into the first power connection hole (32) and the second power connection hole (42) to supply an AC power to the AC power LED (21) through a power connection unit electrically connected to the AC power LED board (20); and a bulb (60) inserted into the bulb fixing groove (31') to cover the AC power LED board (20), wherein two or more AC power LEDs (21) are mounted on the AC power LED board (20), and all of the two or more AC power LEDs (21) are surrounded by a single diffuser (20*b*) to diffuse light, the single diffuser (20*b*) having a tube shape with a threaded outer periphery surface.

2. The bulbtype AC power LED lamp of claim 1, wherein:

the board base (30) includes an inner surface that faces the first power connection hole (32) in a radially inward direction and an outer periphery surface that faces an exterior in a radially outward direction;

the heat sink (33) includes an inner surface that faces in a radially inward direction and an outer surface that faces an exterior in a radially outward direction; and the inner surface of the heat sink (33) covers and comes in contact with the outer periphery surface of the board base (30).

3. The bulbtype AC power LED lamp of claim 1, wherein:

the board base (30) has a shape of a hollow cylinder that includes an inner surface defining the first power connection hole (32) and an outer circumferential surface that faces an exterior in a radially outward direction;

the heat sink (33) includes an inner surface that faces in a radially inward direction and an outer surface that faces an exterior in a radially outward direction; and the inner surface of the heat sink (33) covers and comes in contact with the outer circumferential surface of the board base (30).

* * * * *